US007343853B2

(12) United States Patent
Schmitz et al.

(10) Patent No.: US 7,343,853 B2
(45) Date of Patent: Mar. 18, 2008

(54) PRESS, PARTICULARLY A MULTILEVEL PRESS

(75) Inventors: Christoph Schmitz, Kerken (DE); Klaus Schürmann, Jüchen (DE); Klaus Wollny, Krefeld (DE)

(73) Assignee: Siempelkamp Maschinen-Und Anlagenbau GmbH & Co. KG, Krefeld (DE)

( * ) Notice: Subject to any disclaimer, the term of this patent is extended or adjusted under 35 U.S.C. 154(b) by 33 days.

(21) Appl. No.: 11/170,785

(22) Filed: Jun. 29, 2005

(65) Prior Publication Data

US 2006/0021523 A1 Feb. 2, 2006

(30) Foreign Application Priority Data

Jul. 3, 2004 (DE) ..... 10 2004 032 259

(51) Int. Cl.
*B30B 7/02* (2006.01)

(52) U.S. Cl. ..... 100/194; 100/269.17; 100/324

(58) Field of Classification Search ..... 100/324, 100/325, 193, 194, 195, 214, 269.17; 72/455; 156/580, 583.1; 425/338, 406, 407; 29/428
See application file for complete search history.

(56) References Cited

U.S. PATENT DOCUMENTS

| | | | | | |
|---|---|---|---|---|---|
| 3,479,856 | A | * | 11/1969 | Zeitlin et al. | 72/455 |
| 3,742,537 | A | * | 7/1973 | Merrill | 100/35 |
| 4,222,724 | A | * | 9/1980 | van Hullen | 425/141 |
| 4,963,221 | A | * | 10/1990 | Isobe et al. | 156/358 |
| 5,611,271 | A | * | 3/1997 | Bielfeldt | 100/199 |
| 5,634,398 | A | | 6/1997 | McGee | |
| 6,101,861 | A | * | 8/2000 | VanderZee et al. | 72/405.01 |
| 6,851,358 | B2 | | 2/2005 | Gawlitta | 100/324 |

FOREIGN PATENT DOCUMENTS

| | | |
|---|---|---|
| DE | 195 00 983 | 12/1995 |
| DE | 102 41 119 | 5/2003 |

* cited by examiner

*Primary Examiner*—Jimmy T. Nguyen
(74) *Attorney, Agent, or Firm*—Andrew Wilford

(57) ABSTRACT

A press, especially a multilevel press, has a press stand of one or more press frames whose head and foot pieces are of cast iron and whose vertical uprights or tension shanks are of steel plate construction and formed with T or hammer-heads bearing on the head piece or foot piece.

12 Claims, 10 Drawing Sheets

PRESS, PARTICULARLY A MULTILEVEL PRESS

FIELD OF THE INVENTION

Our present invention relates to a press, more particularly, to a multilevel press for the production of pressed flat workpieces, for example, pressed board or wood-containing boards like chip boards, fiber-board, particle board and the like generally pressed from a mass of cellulosic or wood materials with or without a binder and generally hot pressed at a temperature enabling the binder to be activated or set.

BACKGROUND OF THE INVENTION

A press for producing such products and especially a multilevel press generally comprises a press stand with a single press frame or a plurality of press frames arrayed in a row and wherein each press frame is comprised of a frame head piece and a frame foot piece as well as a pair of lateral shanks under tension connected between the frame head piece and the frame foot piece.

The tensionable shanks can be formed at their ends with hammerheads or formations equivalent to hammerheads which overlie or underlie horizontal bearing surfaces on the frame head piece or the frame foot piece.

In a multilever press of that type, a stationary press head is supported by the head pieces of the frames and is juxtaposed with a movable press bed on the foot pieces of the frames, the press bed being displaceable upwardly and downwardly by, for example, piston-and-cylinder arrangements below the press bed and integrated into the foot pieces of the frame. Between the bed and the head, a plurality of press platens can be provided and between pairs of platens, the workpieces in the form of pressboard mats can be hot pressed to produce the pressed board. The press platens, the head and the bed can all be formed preferably as heated plates.

The multilevel press can be provided on each side with at least one simultaneous closure device which permits the platens to close relative to one another simultaneously as the bed is raised.

Multilevel presses of this type, using press frames arrayed in a row, have had the press stand and especially the press frames constructed completely from steel plates which can be welded, bolted or riveted together from steel plate sections or segments.

Press frames of this type can have horizontal joints between the shanks and the headpiece and/or foot piece and between segments of the uprights. In the region of the joints at which the shanks are to be connected to the head and foot pieces at least, thicker connecting pieces are required and are secured to the steel plates by rivets or bolts so that the frame structures can take up the press forces without deformation (see, for example, German Patent Document 195 00 983 C1).

Multiplaten presses having a frame construction wherein the frame is under tension at least during the pressing stage and having tension rods between force-receiving corner members of the frame head part and foot part have also been provided. To maximize the ability to absorb shear and bending sources, the two lateral tension members are constituted as double-T girders and/or box profiles in German Patent Document DE 44 08 101 and equivalent U.S. Pat. No. 5,611,271.

German Patent Document DE 102 41 119 A1 (U.S. Pat. No. 6,851,358) describes a multilevel press in which the frame shanks have hammerheads as previously described and the hammerheads themselves can bridge head pieces of the frames. The head pieces, foot pieces and other parts of the frame can be fabricated from steel plate sections.

Finally, mention should be made of a type of column press which has been used in the field and which connects the head and base of the press together by press columns which generally are cylindrical in shape. In such a column press with cylindrical columns, the head part and the foot part are composed of castings, with such presses, a problem arises in that with increasing width of the press the space at the sides becomes more limited since the diameters of the cylindrical press columns must increase as a function of the square of the press width. With increasing widths, the heating plates or platens must be of greater thickness to avoid sag. This means that any closing mechanism must be of greater dimensions than would otherwise be advantageous and that requires more space. Such presses, therefore, are unwieldly.

OBJECTS OF THE INVENTION

It is the principal object of the present invention to provide a press, especially a multilevel press, which avoids drawbacks of earlier presses and especially can be provided with large press widths and a simple and inexpensive construction.

Another object of this invention is to provide an improved press of the type described which has simplified mounting or assembly, greater lateral accessibility and an overall simpler construction.

Still another object of this invention is to provide a press frame for such a press which has a simplified construction.

SUMMARY OF THE INVENTION

These objects and others which will become apparent hereinafter are attained, in accordance with the invention in a press for pressing a flat workpiece which comprises:

a press stand having at least one press frame formed with a head piece, a foot piece and a pair of tensionable lateral uprights between the head piece and the foot piece, each of the uprights having a hammerhead element at an upper end overlying a horizontal support surface of the head piece and a hammerhead element at an lower end underlying a horizontal support surface of the foot piece;

a lower press platen braced against the foot piece;

an upper press platen braced against the head piece; and a pressing force generator on the stand for displacing one of the platens relative to the other of the platens to press at least one flat workpiece between the platens, at least one of the head piece and the foot piece being formed from at least one casting and the tensionable lateral uprights being formed of a welded, bolted and/or riveted steel-plate construction.

Preferably the press is a multiplaten press wherein the stand is formed from a plurality of the press frames, mutually spaced apart in a row, the lower press platen forming a press bed, the upper press platen forming a press head, the press having a plurality of further press platens being received between the press bed and the press head whereby respective pressed-board workpieces are pressed between the platens.

The objects of the invention will thus be attained in a multilevel press especially for chip-board, fiberboard or like wood or wood material boards in which the head piece of the frame and/or the foot piece of the frame, or of one or more frames, is formed as a one piece or multipiece casting or cast structure while the lateral tensionable shanks with the hammerhead formations at top and bottom of the uprights are of welded and/or bolted or riveted steel plate construction.

The tensionable shanks can preferably each be formed from at least two parallel spaced apart steel plate members interconnected by at least one transverse strut or spacing element, whereby on each of these shanks forming a common upright, at each end, a hammerhead is provided.

The invention thus combines a cast structure in the form of the frame head piece and/or frame foot piece with a steel plate construction for the lateral shanks. By contrast with conventional frame constructions, the steel plate structures are avoided for the head piece and the foot piece and instead one or more castings are there employed. Nevertheless, cylindrical press columns to connect these castings are not used but rather the lateral tensionable upright or shanks themselves are formed of welded and/or bolted steel plate structures which in a plan view from above or from below can have a box shape, U-shape, C-shape or H-shape and a corresponding cross section, with the hammerheads applied to the webs of this cross section. Because of this combined construction, high stabilities of the frames are insured and the press can have a simple construction, especially allowing ample space for the simultaneous closing units, heat-fluid piping or heating conductors and various fittings connections that might be required.

In spite of the simplicity of the overall construction, the head piece and foot piece can be of cast construction and in a simple manner may be cast in one piece or made a number of castings which can be easily bonded together so that the cylinder seats can be provided in the headpiece or foot piece without difficulty or integrated therein. A cast piece in accordance with the invention refers to a body made by casting, especially by casting into its finished or final form and especially from cast iron. Preferably the headpiece and foot piece of the frame can be made from ductile gray cast steel.

According to a feature of the invention in a first embodiment, the transverse strut or struts are welded at opposite ends to the two steel-plate shanks forming each upright of a respective frame so that the tensionable shanks as a whole are of welded construction. Alternatively, or in addition, the transverse strut or struts, which can be bars, plates, ribs, tubes or the like can be attached to the steel plate sections by bolting or riveting or a combination of welding or bolt.

In one preferred configuration, the transverse struts are hollow tubular members and a threaded rod can be provided through the tubular member or within the latter and can pass through bores in the steel plate segments to which the struts are to be connected. To provide an especially effective force transfer from the tensionable shanks via the hammerhead formations to the frame headpiece or frame foot piece, the invention provides not only that the width of the hammerhead be greater than the thickness of the steel plate shank but also that the length of the hammerhead be greater than the width of the steel plate shank. When overlong hammerheads are provided by comparison with the steel plate shanks, the surfaces which are engaged by the hammerheads can be extended as well. The steel plate shanks form one piece or can be unitary with the hammerheads at the respective end.

The steel plate shank, however, can be formed in one piece except for the hammerhead formations or t-shaped end pieces provided at the ends thereof, e.g. by welding. Preferably, however, each steel plate shank is composed of two or more segments which are welded together end to end and are composed of steel plate. At the end of this construction, the hammerhead element or formation can be welded. The tensionable shanks are preferably substantially smoot and planar members without mounting elements laterally formed thereon. The weld seams can be throughgoing and continuous. The shanks can be free from mounting elements which are affixed through camfered weld grooves or seams. If mounting elements are provided, that can be attached by bolt or plug connections to insure a greater strength and stability for the press frame. According to a further feature of the invention, the frame headpiece and/or the frame foot piece, formed as castings, can have lateral receiving shanks or cantilevered arms defining slits or slots between them which are of a pocket shape and, for example, are laterally open to receive the tensionable shanks. These laterally open pocket shaped receiving slots greatly simplify the assembly of the press. A fixing of the tensionable shanks can be accomplished with vertical clamping solutions which are passed through the hammerhead formations into the horizontal supporting surfaces thereof. Surprisingly, the headpiece and foot piece formed as cast parts with the laterally open receiving pockets satisfy all requirements for stability of the frame.

This is especially the case when the receiving shanks or cantilevered arms are connected together externally by connecting clamps. These connecting clamps can have a U-shape or U-shaped cross section, and can also be applied from the exterior to the receiving pockets.

In a particularly preferred feature of the invention, each two neighboring frame head pieces and/or two neighboring frame foot pieces can be connected together by connecting springs. The connecting springs can be configured as double bar T springs which can have their cross bars or T shanks fastened to the frame head and/or foot pieces, for example by bolting. A double-T spring is a spring having a double-T shape or, equivalently, a H shape. Such connecting springs ensure a permanent and secure connection of the individual press frames in the horizontal direction. Simultaneously they compensate for relative movements or permit compensatory relative movements in the vertical direction.

According to still another feature of the invention on interior surfaces of the tension shanks, guide elements with guide surfaces can be connected, preferably by bolts or a screw connection. To these guide elements or on these guide surfaces heating plates can be connected with corresponding guide surfaces, the guide elements likewise being attached to the heating plates by bolts or a screw connection. The guide surfaces allow the displacement of the press platens during opening and closing of the press by permitting the platens or heating plates to be displaced along the press frames. The guide surfaces can be inclined to accommodate large thermal expansion or contraction during temperature fluctuations in the press. For example vertical guide surfaces as seen in a plan view may be inclined at predetermined angles to the longitudinal direction. These angles can lie between 20° and 60°, preferably between 30° and 50°, and most preferably at about 35°. The bracing units along the interiors of the shanks for the heating plates can have the configuration of stepped plates. The stepped plates serve to brace the heat plates or platens especially when the press is open.

Between the frame head or foot pieces and the press head and/or the press bed, compensating or counter heating plates can be arranged. These compensating heating plates enable uniform heating of the head and bed which also can be made as cast pieces. These compensating heating plates need not serve as press platens and may only function as heating units. The counter heating plates can be connected to the head and foot pieces of the frame by compression resistant thermal insulation. However between the counter heating plates and the press head or bed, insulation is not provided to ensure the most effective heat transfer to the head or bed.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
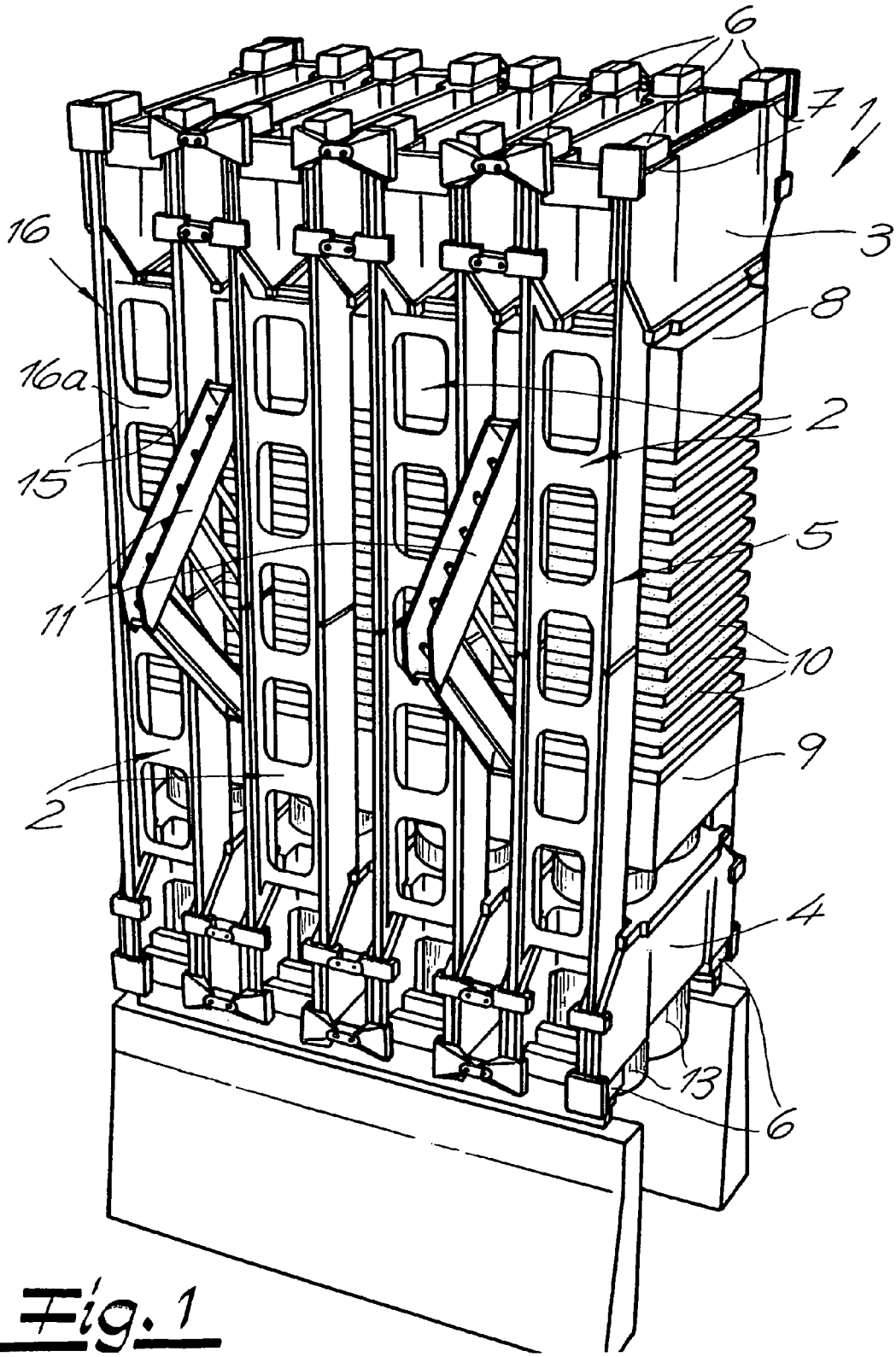
FIG. 1 is a perspective view of a multiplaten press according to the invention.

In the drawing we have shown a multiplaten press for the production of chip board, fiber board or other wood particle board in which mats to be pressed are placed along the bed, the platen and below the head of the press and are hot pressed to boards. Such a press can also be used to laminate boards, to produce plastic boards and for pressed or particle board of other types with or without thermally activatable binders.

The press has a press stand 1 formed here of four press frames 2 arrayed in a row, in spaced apart relationship, one after another.

Each press frame 2 is comprised of a frame head piece 3 and a frame foot piece 4 (FIG. 2) and two lateral vertical tension shanks 5 connecting the head piece 3 and the foot piece 4 at each end thereof. The tension shanks 5 serve as press columns. Tension shanks 5 are provided with hammerhead formations 6 at their ends which overlie horizontal support surfaces 7 on the head piece 3 and underlie horizontal support surfaces 7 on the foot piece 4. The four head pieces 3 and the four foot pieces 4 are each formed as one-piece castings. By contrast, the lateral tension shanks with the hammerhead formations 6 are formed as welded and/or bolted steel plate constructions.

The press in FIG. 1 is shown to comprise, in addition, a fixed press head 8 which can be a one-piece casting of gray cast iron and a bed 9 which likewise can be formed of one piece of gray cast iron and which can be raised and lowered by means of piston and cylinder units 13. Between the head 8 and the bed 9, a multiplicity of press platens 10, formed as heating plates, can be provided. To the bed 9 and the platens 10 of the press can be connected two simultaneous closing units 11 on each longitudinal side of the press to progressively close the gaps between the platens 10 as the bed 9 is raised. The frame foot pieces 4 of the four frames forming the press stand 1 are each castings of gray cast iron provided with two cylindrical seats or recesses 12 for the press cylinders 13 in which press pistons 14 are displaceable.

The tension shanks 5 forming the uprights for each of the frames are each fabricated of two mutually parallel spaced apart steel-plate shank elements 15 which can be connected on each side of the frame by a transverse plate or a plurality of spacing elements or bars 16*a* referred to generally as transverse struts. At each end, each of the steel plate shanks 15 is connected with a respective hammerhead formation 6 so that at the ends of each tension shank 5 respective pairs of hammerheads 6 are provided.

Figure 2:
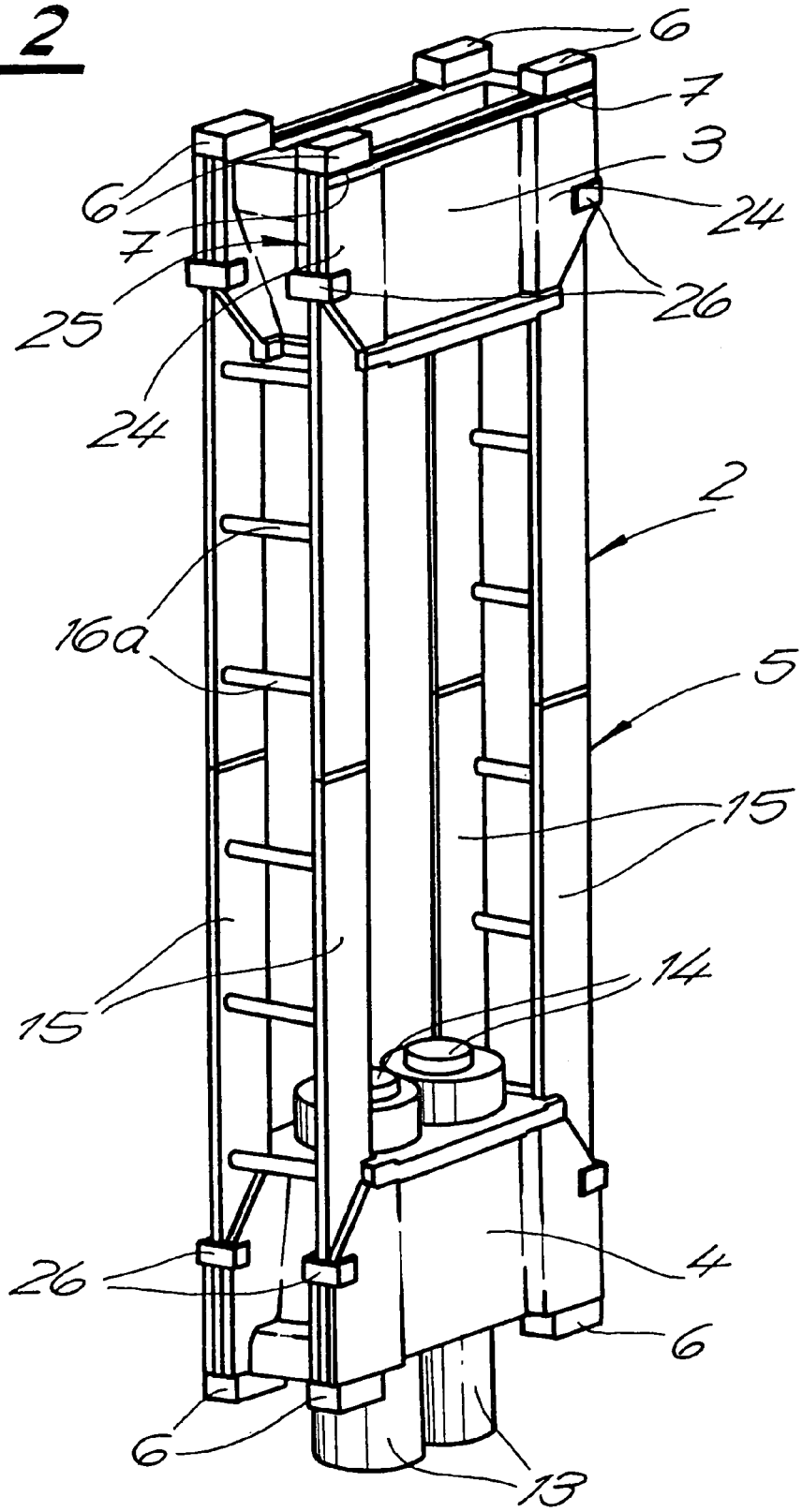
FIG. 2 is a perspective view of the press frames of the multiplaten press of FIG. 1, slightly modified with respect to the press frames there shown.
Figure 3:
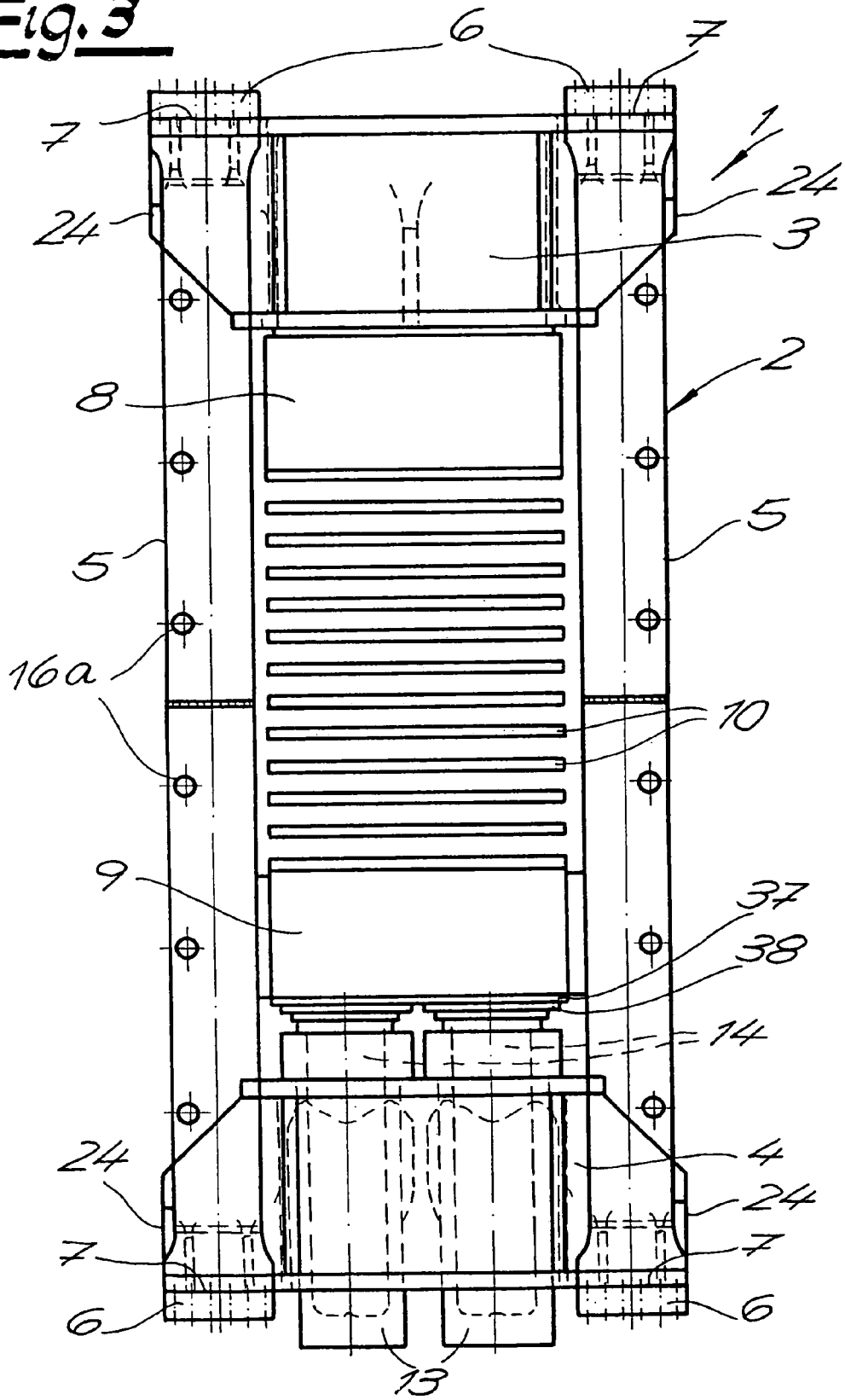
FIG. 3 is an end view in diagrammatic form of the multiplaten press.
Figure 11:
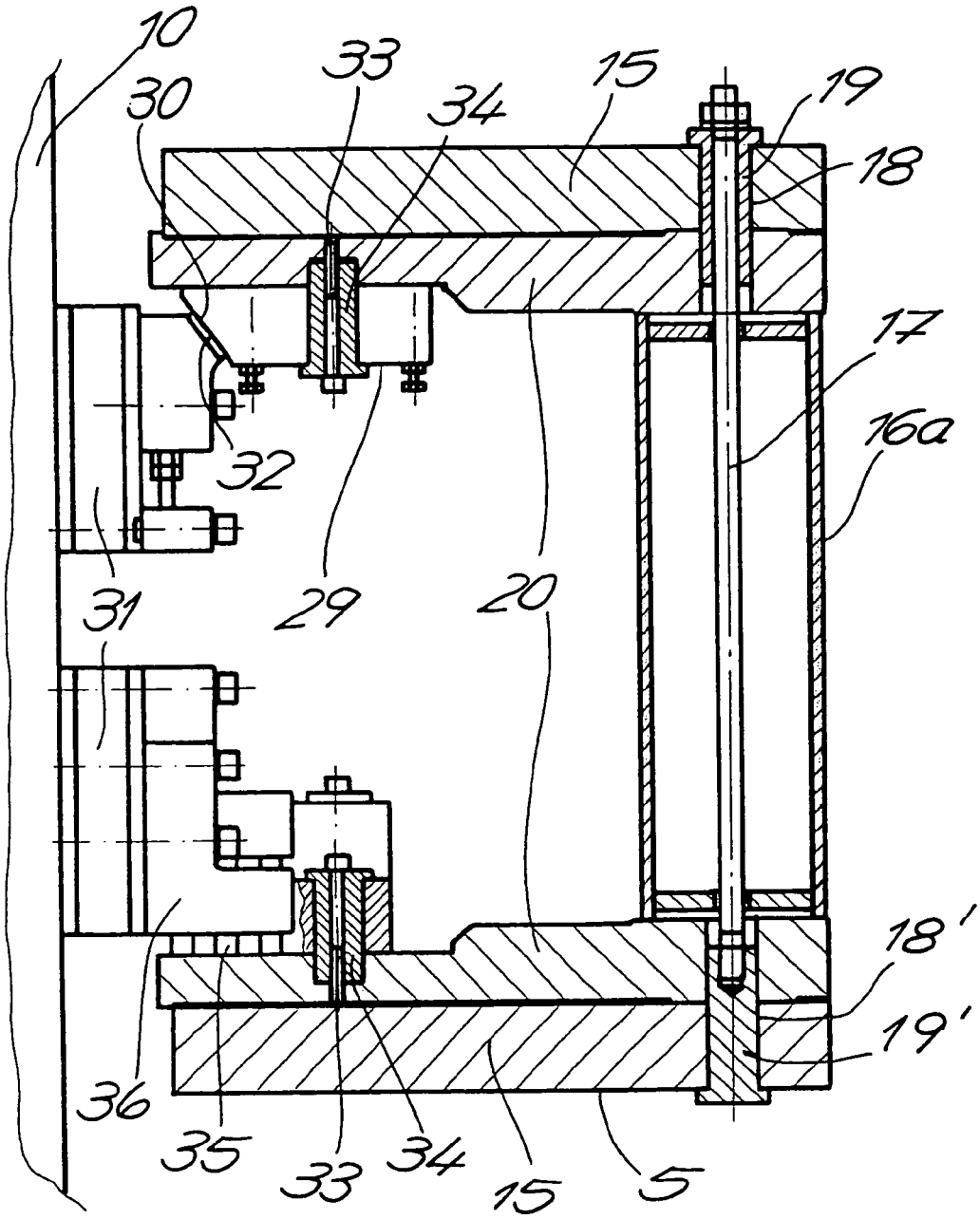
FIG. 11 is a detail of FIG. 10.

In the embodiment illustrated in FIG. 1, the spacer elements 16*a* forming the struts are plates 16 with cut outs defining the ribs or struts at 16*a* between them. By contrast, FIG. 2 shows an embodiment in which a multiplicity of transverse struts 16*a* are provided between the tension elements and are in the form of tubular members (see FIG. 11). In this illustration it is clear that the struts 16*a* are formed as tubular members each traversed by a threaded rod 17 whose ends are anchored in the shanks 15. For that purpose the shanks 15 are provided with bores 18, 18' in which nuts 19' or tubular pins 19 are tightly fitted. The nut 19' is so designed that it projects only slightly beyond the tension shank 5. The press can thus be relatively compact since the threaded rod 17 terminates in the nut 19'. This can be advantageous when space is required for the simultaneous closing device and piping or cabling. The rod 17 may be clamped by a nut at its outer end against the threaded pin 19. FIG. 11 also shows that the tubular member 19*a* can be braced between the respective mounting plates 20 and the steel plate shanks 15.

The width B of the hammerheads 6 (FIG. 7) is greater than the thickness d of the steel plate shank 15. In addition, the length L of the hammerhead 6 is greater than the width b of the shank plate 15 so that an especially large bearing surface is provided between the hammer head 6 and the supporting surfaces 7 of the head part and foot part of the frame. The steel plate shank 15 can be formed either as a one piece member or as a member fabricated from a plurality of steel plate segments. It can be made for example from two steel plate segments 15*a* and 15*b* which are welded together at their adjoining ends in a weld seam 21. At their opposite ends the steel plate segments 15*a* and 15*b* are welded to the T-end pieces 22 by further weld seams 23, the end pieces being provided with the hammerhead 6 so that the steel profile (shown in FIGS. 6 and 7) can be obtained.

Figure 5:
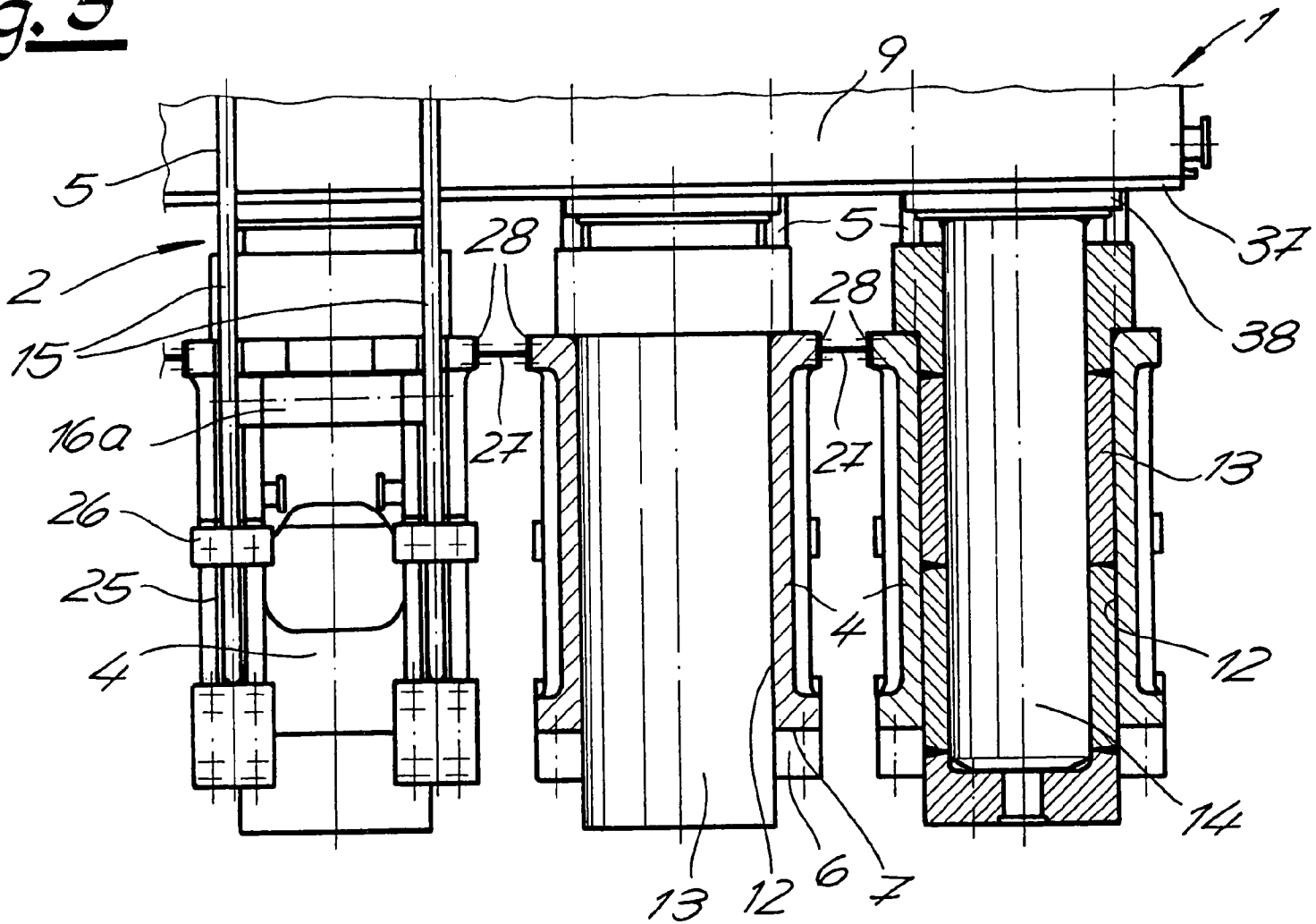
FIG. 5 is a detail of FIG. 4.

The frame head parts 3 are each formed with a pair of receiving shanks in the form of cantilever arms 24 which project laterally from the head part and in pairs to define laterally open receiving slits 25 into which the tension shanks 5 or their steel-plate members 15 are received (FIG. 5). These pockets 25 can also be seen in FIGS. 2 and 9.

Figure 9:
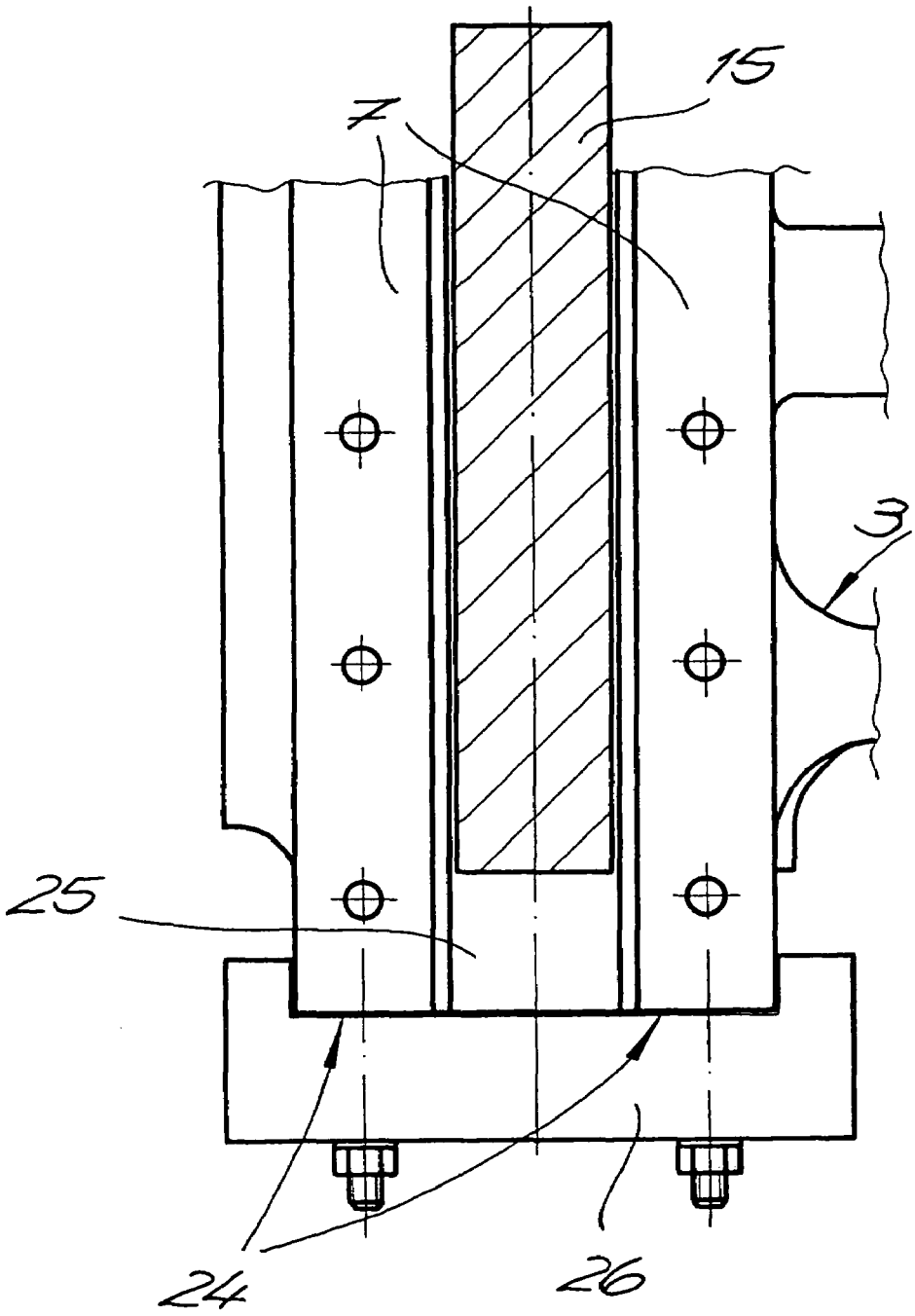
FIG. 9 is a detail of a horizontal section of a portion of FIG. 2.

To prevent a deflection or bending of the cantilever arms on the exterior of the head part and the foot part 4 which can likewise have such arms, connecting clamps 26 can be provided which span each pair of arms 24 and prevent them from spreading apart, one of the clamps 26 is best seen in FIG. 9. The connecting clamps 26 themselves may be C-shaped or U-shaped and are of a C-shaped or U-shaped cross section and connected by means of screws laterally to the cantilever arm 24.

FIG. 5 also shows clearly that each two neighboring frame head parts 3 or frame foot parts 4 can be interconnected by connecting springs 27. These springs 27 are of double T cross section or H cross section and have their T heads 28 connected by screws to the head parts 3 or to the foot parts 4. The webs of the double T sections run perpendicular to the plane of the paper in FIG. 5 and in horizontal planes. As a consequence, the connecting springs 27 stabilize the foot or head pieces relative to one another in the horizontal direction while they permit relative movement in the vertical direction.

Figure 6:
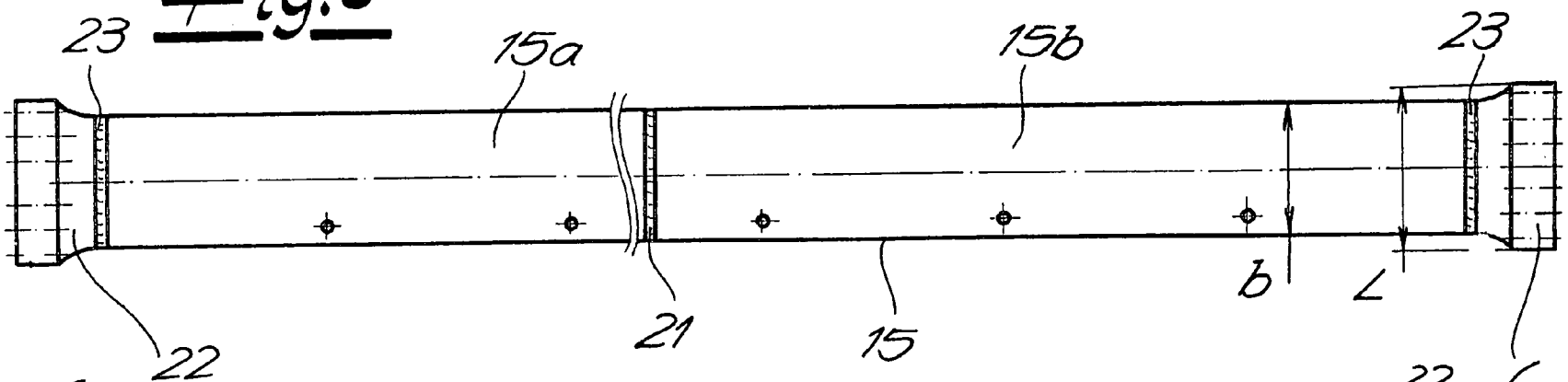
FIG. 6 is an elevational view from the side of a part of the tension shanks.
Figure 7:
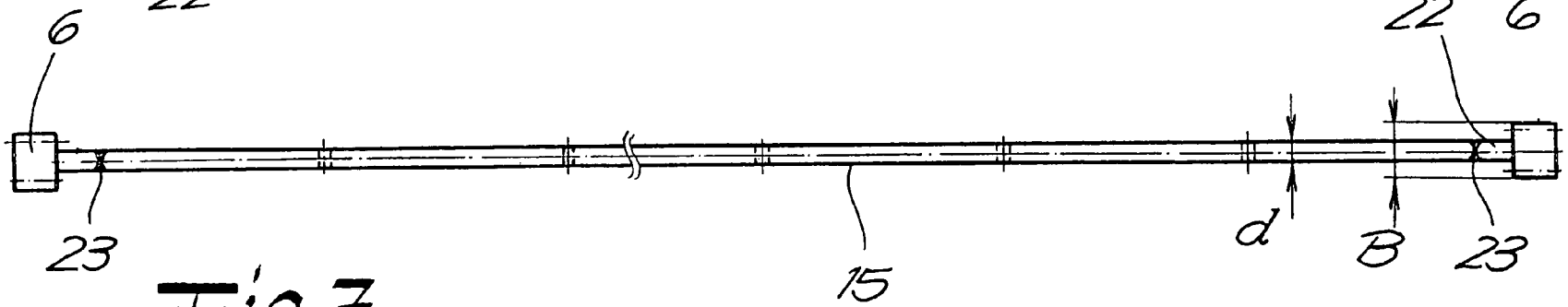
FIG. 7 is an elevational view at a right angle to the view of FIG. 7.
Figure 8:
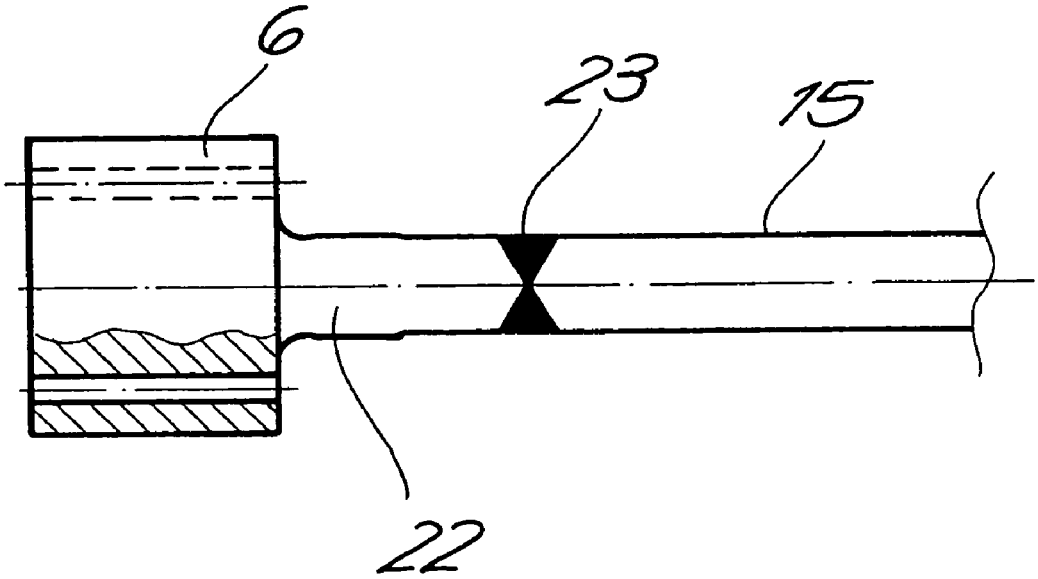
FIG. 8 is a detail of FIG. 7.
Figure 10:
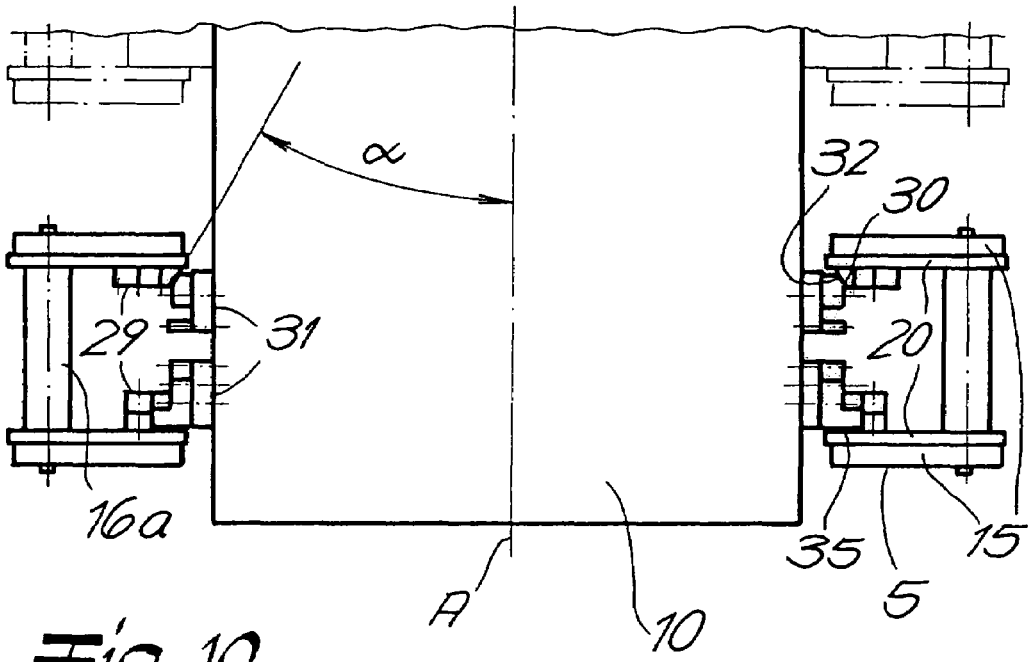
FIG. 10 is a detail of a plan view of a portion of FIG. 3 showing a heating plate thereof.

The drawing and especially FIGS. 6 to 8 show further that the steel plate shank 15 is practically smooth and planar without mounting elements welded thereto. Any mounting elements which may be attached thereto (see FIGS. 10 and 11) can be connected thereto by a screw connection or bolts and/or a plug connection. A weld connection with beveled weld seams is therefore avoided. The mounting elements can be provided on the interior of the tension shanks 5 in the form of guide elements 29 (FIG. 10) with vertical guide surfaces 30 for the heating plates or platens 10. Correspondingly, on the heating plates 10 guide elements 31 with corresponding vertical guide surfaced 32 can be bolted (see FIGS. 10 and 11). The guide surfaces 30, 32 in a plan view can lie at a predetermined angle $\alpha$ of about 35° relative to the longitudinal axis A of the press. The guide elements 29, connected via screws 33 and appropriate pins or bushings 34, can engage the mounting plates 20 as previously described rather than the planar steel plate shanks 15 directly (see FIG. 11). In a similar manner stepped plates 35 can be provided on the mounting plates to enable height adjustment of the horizontal supporting surfaces for the platens 10. The platens 10 can then have corresponding supporting elements 36 in the form of angles or similar structural shapes which cooperate with the stepped plates and the supporting surfaces.

Figure 4:
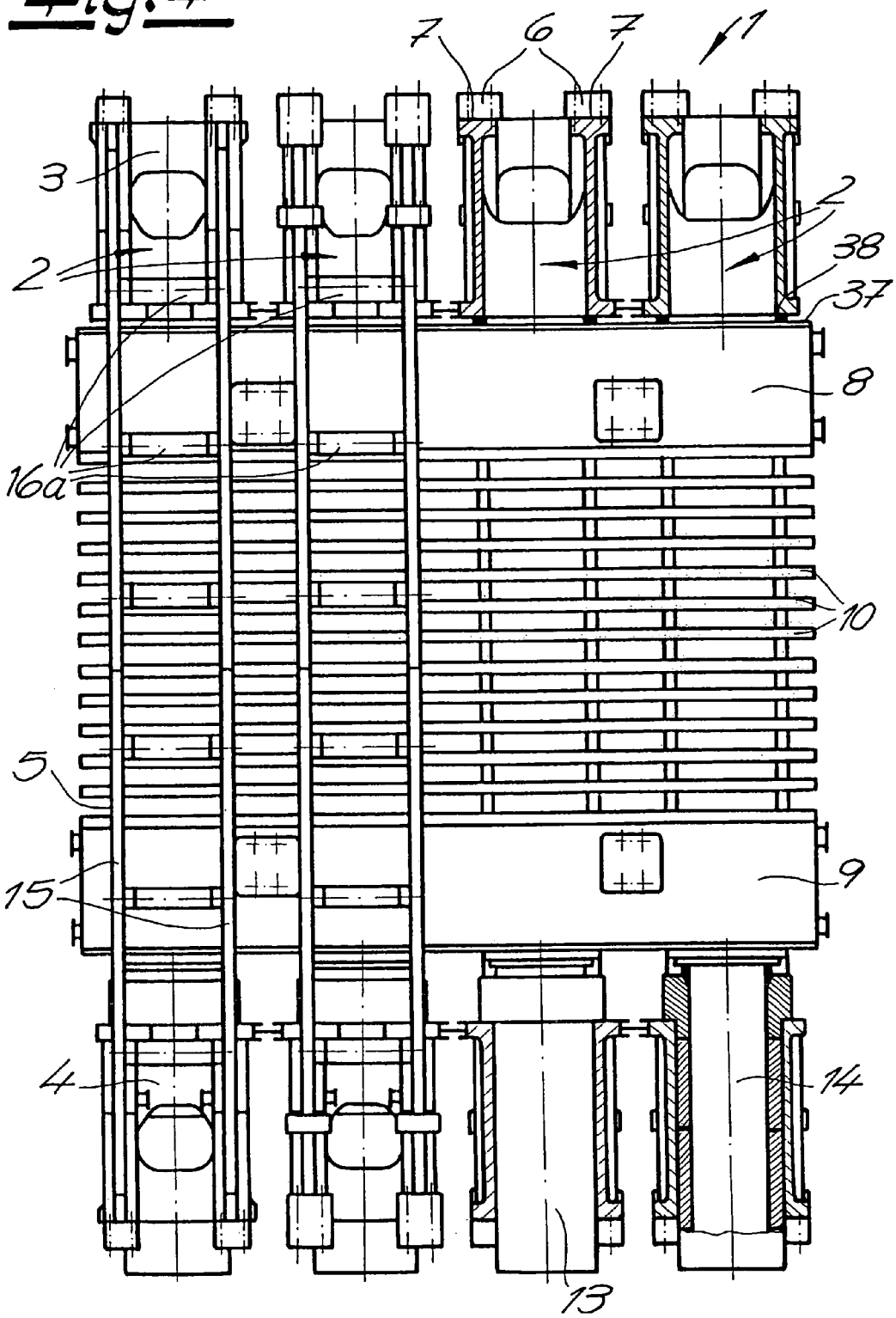
FIG. 4 is a side view of the press of FIG. 1 partly broken away and partly shown in cross section.

Between the frame head pieces 3 and the press head 8 on the one hand and between the frame foot pieces 4 and the press bed 9 on the other, respective compensating heating plates 37 (FIG. 4) or counter heating plates can be provided. Between the compensating heating plates 37 and the head or foot piece a compression resistant insulation 38 is positioned. The compensating heat plates 37 like the platens 10 are heated to prevent nonuniform heating of the head 8 and the bed 9 of he press. Members 3 and 4 are preferably composed of gray cast iron as has been noted and especially high ductility cast iron, for example, EN-GJS-400.

We claim:

1. A multiplaten press for pressing flat workpieces, the press comprising:

a row of spaced apart press frames each formed with a cast-iron head piece formed with a pocket-like receiving slit, a cast-iron foot piece formed with a pocket-like receiving slit, and a pair of tensionable lateral uprights between the head piece and the foot piece, each of the uprights having a hammerhead element at an upper end overlying a horizontal support surface of the head piece and a hammerhead element at a lower end underlying a horizontal support surface of the foot piece, each of the uprights further being comprised of at least two generally parallel shanks formed of welded, bolted, and/or riveted-together steel plates and interconnected by at least one respective transverse strut;

a lower press platen braced against the foot pieces;

an upper press platen braced against the head pieces;

a plurality of intermediate platens between the lower press platen and the upper press platen; and a pressing force generator for displacing one of the upper and lower platens relative to the other of the upper and lower platens to press the flat workpieces between the platens, said slits being defined between a pair of cantilever arms secured together externally of said slits by a connecting clamp.

2. The press defined in claim 1 wherein said struts are welded at opposite sides to the respective shanks.

3. The press defined in claim 1 wherein said transverse struts are tubular members joined by screw connections at opposite ends with the respective shanks.

4. The press defined in claim 1 wherein the hammerhead elements each have a width greater than a thickness of the shanks and a length greater than a width of the shanks.

5. The press defined in claim 4 wherein each of the shanks forms with the respective hammerhead elements a respective unitary steel-plate segment.

6. The press defined in claim 5 wherein each of the shanks is formed from a unitary steel-plate segment to each end of which a hammerhead element or a T-section end piece forming the respective hammerhead element is welded.

7. The press defined in claim 1 wherein each of the shanks is formed from a plurality of steel plate segments welded together in end-to-end relationship to each end of which the respective hammerhead element or a T-section end piece forming the respective hammerhead element is welded.

8. The press defined in claim 1 wherein adjacent head pieces are interconnected by connecting springs and adjacent foot pieces are connected by connecting springs.

9. The press defined in claim 8 wherein each of said connecting springs is a double-T spring having a respective T head bolted to the respective head piece or foot piece.

10. The press defined in claim 1 wherein each of the shanks is substantially smooth and free from welded-on mounting elements.

11. A multiplaten press for pressing flat workpieces, the press comprising:

a having a row of spaced apart press frames each formed with a cast-iron head piece, a cast-iron foot piece, and a pair of tensionable lateral uprights between the head piece and the foot piece, each of the uprights having a hammerhead element at an upper end overlying a horizontal support surface of the head piece and a hammerhead element at a lower end underlying a horizontal support surface of the foot piece;

a lower press platen braced against the foot pieces;

an upper press platen braced against the head pieces;

a plurality of intermediate platens between the lower press platen and the upper press platen; and a pressing force generator for displaying one of the upper and lower platens relative to the other of the upper and lower platens to press the flat workpieces between the platens, each of the tensionable lateral uprights being internally formed with guide elements having guide surfaces which can be bolted to the respective upright and guide elements with complementary guide surfaces bolted on respective intermediate platens.

12. A multiplaten press for pressing flat workpieces, the press comprising:

a row of spaced apart press frames each formed with a cast-iron head piece, a cast-iron foot piece, and a pair of tensionable lateral uprights between the head piece and the foot piece, each of the uprights having a hammerhead element at an upper end overlying a horizontal support surface of the head piece and a hammerhead element at a lower end underlying a horizontal support surface of the foot piece;

a lower press platen braced against the foot pieces;

an upper press platen braced against the head pieces;

a plurality of intermediate platens between the lower press platen and the upper press platen; and a pressing force generator for displacing one of the upper and lower platens relative to the other of the upper and lower platens to press the flat workpieces between the platens, each tensionable lateral upright being internally formed with a supporting profile for a respective one of the intermediate platens, the supporting profile comprising stepped plates, said intermediate platens having support elements corresponding to said stepped plates and connected therewith.

* * * * *